US007870639B2

(12) United States Patent
Thomas

(10) Patent No.: US 7,870,639 B2
(45) Date of Patent: Jan. 18, 2011

(54) SPRAY EXTRACTION NOZZLE FOR TAKING IN LIQUIDS FROM A SURFACE

(75) Inventor: Paul Gerhard Thomas, Neunkirchen (DE)

(73) Assignee: Robert Thomas Metall - und Elektrowerke GmbH & Co. KG, Neunkirchen (DE)

( * ) Notice: Subject to any disclaimer, the term of this patent is extended or adjusted under 35 U.S.C. 154(b) by 718 days.

(21) Appl. No.: 11/823,719

(22) Filed: Jun. 28, 2007

(65) Prior Publication Data

US 2008/0016642 A1 Jan. 24, 2008

(30) Foreign Application Priority Data

Jul. 18, 2006 (DE) ..... 10 2006 033 514

(51) Int. Cl.
*A47L 9/06* (2006.01)

(52) U.S. Cl. ..... 15/322; 15/373; 15/401

(58) Field of Classification Search ..... 15/322, 15/373, 368, 393, 400, 401; *A47L 9/06*
See application file for complete search history.

(56) References Cited

U.S. PATENT DOCUMENTS 2,885,717 A * 5/1959 Lampe ..... 15/417
3,616,482 A 11/1971 Brycki
3,815,171 A 6/1974 Carr et al.
4,218,900 A 8/1980 Caplan et al.
4,893,375 A * 1/1990 Girman et al. ..... 15/321
5,625,920 A * 5/1997 Bores et al. ..... 15/322

FOREIGN PATENT DOCUMENTS

EP 0176686 4/1986
WO WO 87/01920 4/1987

* cited by examiner

*Primary Examiner*—David A Redding
(74) *Attorney, Agent, or Firm*—Lucas & Mercanti, LLP; Klaus P. Stoffel

(57) ABSTRACT

A spray extraction nozzle for taking in liquids which have been applied to a surface includes a suction duct which ends in a suction mouth, and a spray nozzle, as well as an adapter for working on surfaces which have different properties. The adapter is connected to the spray extraction nozzle through a pivot axis, and the adapter can be pivoted from a position of rest which is remote from the suction mouth to a position of operation in front of the suction mouth of the spray extraction nozzle.

8 Claims, 4 Drawing Sheets

SPRAY EXTRACTION NOZZLE FOR TAKING IN LIQUIDS FROM A SURFACE

BACKGROUND OF THE INVENTION

1. Field of the Invention

The present invention relates to a spray extraction nozzle for taking in liquids which have been applied to a surface. The spray extraction nozzle includes a suction duct which ends in a suction mouth, and a spray nozzle, as well as an adapter for working on surfaces which have different properties.

2. Description of the Related Art

Such a spray extraction nozzle is disclosed in U.S. Pat. No. 3,616,482 A. Such spray extraction nozzles have been known for a long time. They have the purpose of taking in through the suction mouth liquids which have been applied to a surface and of feeding the liquids through the suction duct and possibly suction lines to a suction apparatus. the suction mouth usually has two hard, rigid lips between which the liquid can be taken in. The suction mouth having two rigid lips is usually intended for carpet floor covering. In this connection, it must always be ensured that the two lips of the suction mouth are placed as exactly as possible on the carpet in order to produce an optimum suction effect. For example, if the lips of the suction mouth are not pressed both onto the carpet because of an inclined position of the suction mouth of the spray extraction nozzle, the suction effect is substantially reduced and the residual moisture is significantly increased.

If other types of surfaces, for example, hard surfaces, are to be freed of liquids which have been applied to the surfaces, it is possible to place adapters onto the conventional spray extraction nozzles, wherein the adapters have at least one rubber lip by means of which the liquids can be more easily removed from the hard surfaces. A disadvantage in this connection is the fact that placing these adapters on the spray extraction nozzles is usually complicated and that the adapters are not available at the time they are needed and it is necessary to search for them; in addition, if the adapters are removed by hand, the hands become dirty easily.

SUMMARY OF THE INVENTION

Therefore, it is the object of the present invention to provide adapters for spray extraction nozzles which do not have to be necessarily moved into and out of their effective positions, the adapters are not easily lost, and a residual moisture which is as small as possible remains on the surfaces when the adapters are used.

For this purpose, the present invention provides that the adapter is connected to the spray extraction nozzle through a pivot axis, and that the adapter can be pivoted from a position of rest which is remote from the suction mouth to a position of operation in front of the suction mouth of the spray extraction nozzle.

By attaching the adapter to the spray extraction nozzle, it is ensured that the adapter does not get lost. The pivoting movement can be carried out, for example, by foot so that a manual operation is no longer necessary and the hands no longer become dirty.

In accordance with an advantageous feature, the adapter can be releasably locked in the position of operation. To ensure that the adapter remains in the position of operation even when larger pressures and transverse loads act on the adapter, a stop is provided against which the adapter can be pivoted into the position of operation, and a locking device which locks the adapter in the position of operation in such a way that it remains at the stop during each possible phase of operation. If necessary, the locking device can be released and the adapter can be pivoted out of the position of operation.

If the adapter is releasably locked in the position of rest, it is ensured that the adapter cannot pivot unintentionally from the position of rest into the position of operation.

In accordance with a remarkable feature, the adapter constitutes in its position of rest a support surface for the spray extraction nozzles on the surface to be processed; in addition, an optimum position of the suction mouth relative to the surface to be processed is obtained. The position of rest of the adapter is configured in such a way that the spray extraction nozzle rests with a large surface area thereof on the adapter and the two lips of the nozzle mouth are positioned in an optimum manner relative to the surface.

In accordance with a useful feature, the pivot axis is constructed of two pieces and at least one piece of the pivot axis is changeable in its position, wherein the change of position of the pivot axis is effected through an actuating device, and wherein the degree of the change of position of the pivot axis is adjusted at least in such a way that the pivot axis can be pulled back out of the bore of the adapter in which the axis is received.

As a result of this feature, the adapter can be exchanged for other adapters, so that an optimum adjustment to any surface to be processed becomes possible.

In accordance with a particularly advantageous feature, the spray extraction nozzle has an essentially triangular shape with lateral projections.

The lateral projections are arranged in such a way that the spray extraction nozzle can also be moved at least partially under outwardly protruding projections as they may be produced, for example, by pieces of furniture, so that no visible unprocessed edges can be produced even in the areas of pieces of furniture.

In accordance with another useful feature, the suction duct has over the entire length thereof the same cross-section as the suction mouth. This ensures that the removal of liquid in the interior takes place in an optimum manner, that essentially laminar flow is created and no differences in velocity occur. In addition, this feature ensures that when the suction apparatus is turned off, any liquid which has already been taken in cannot flow back.

In accordance with another advantageous feature, the spray nozzles are provided with guide ducts.

The guide ducts have the effect that any cleaning agent leaving the spray nozzle cannot be propelled beyond the edge of the spray extraction nozzle, for example, against walls or furniture, but that the cleaning agent is sprayed exactly through the guide ducts against the surfaces to be processed.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
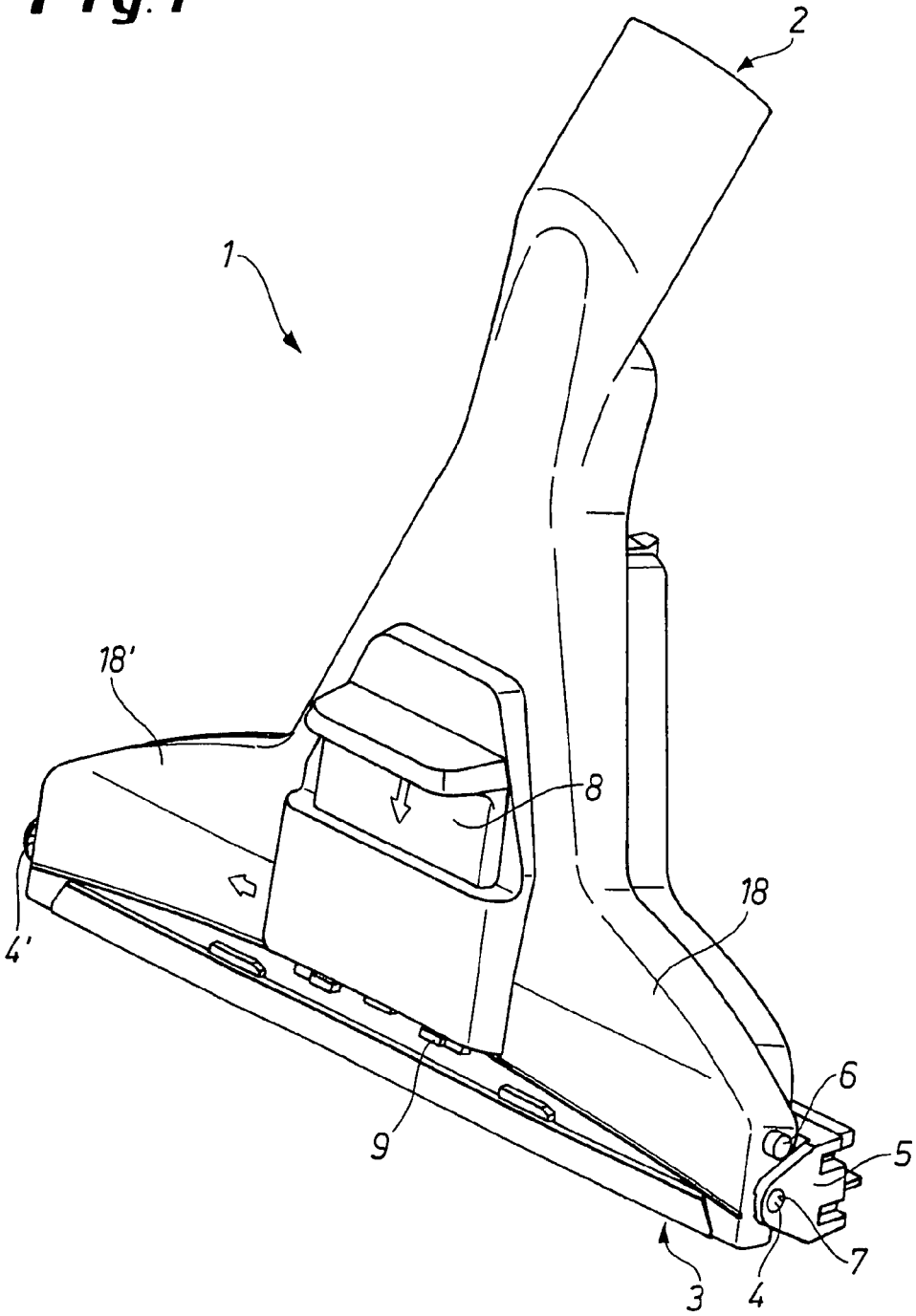
FIG. 1 is a perspective view of a spray extraction nozzle with adapter in the position of rest.

FIG. 1 of the drawing shows a spray extraction nozzle 1 with a suction duct 2 and a suction mouth 3. An adapter 5 is connected to the spray extraction nozzle 1 through a pivot axis 4, 4'. The pivot axis 4 can be displaced in the longitudinal direction thereof through an actuating device 6 so that, when the actuating device 6 is pressed in, the pivot axis 4 is moved out of the bore 7 of the adapter 5. Consequently, the adapter 5 becomes free at one of its two points of suspension and can be removed and replaced with a new or a different adapter.

FIG. 1 further shows a locking device 8 which can be moved downwardly against the force of springs, not shown. Hooks 9 in the form of barbed hooks are arranged at the lower end of the locking device 8. The barbed hooks can engage in appropriate counter hooks of the adapter 5. The effect of the barbed hooks ensures that, when a transverse load occurs or bending of the adapter 5 occurs, the adapter 5 is always more strongly engaged with the locking device 8, so that an unintentional folding away of the adapter 5 is prevented.

Figure 2:
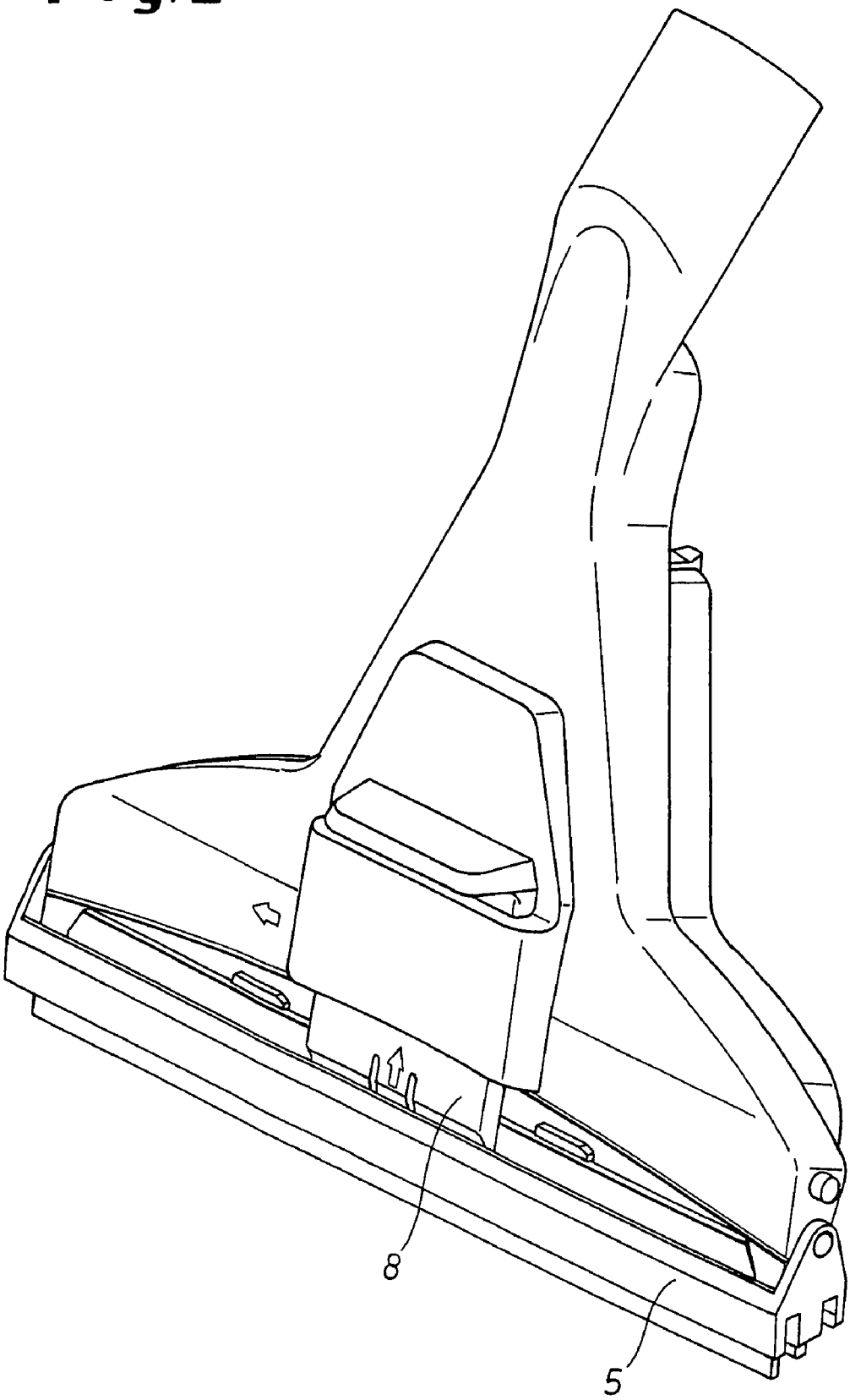
FIG. 2 is a perspective view of a spray extraction nozzle with adapter in the position of operation.

In the illustration of FIG. 2, the adapter 5 is pivoted in front of the suction mouth 3, and the locking device 8 holds the adapter 5 in the position of operation as it is illustrated in the drawing.

Figure 3:
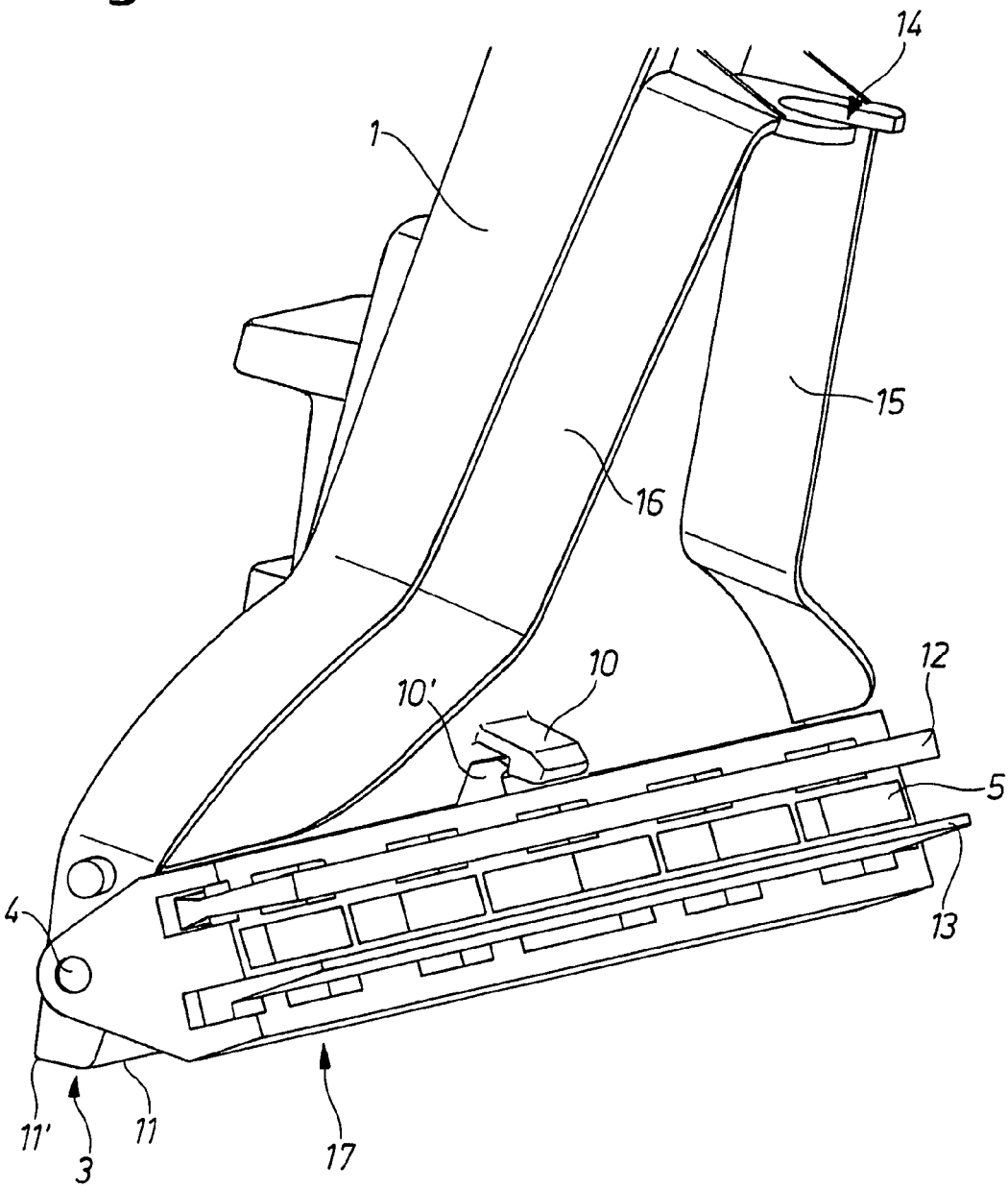
FIG. 3 is a perspective rear view of the spray extraction nozzle with adapter in the position of rest.

FIG. 3 shows the spray extraction nozzle 1 in a rear view. In this view, hooks 10, 10' can be seen which hold the adapter 5 in the position of rest. The hooks 10, 10' are snap hooks which, by simple actuation of the adapter 5, for example, by a foot, snap resiliently apart from each other and release the adapter 5 from the position of rest.

Different from the suction mouth 3 which has two fixed lips 11, 11', the adapter 5 has at least one bristle ledge 12 and at least one rubber lip 13 by means of which liquids can be pushed together in an optimum manner on hard surfaces and can then be suctioned off.

FIG. 3 further shows a locking mouth 14 into which a spray nozzle can be placed. The spray nozzle is downwardly aligned between guide elements 15, 16 in such a way that the spray jet cannot be sprayed laterally beyond the guide elements 15, 16. As a result, walls and furniture do not become wet when the spray extraction nozzle is used nearby.

Moreover, the drawing shows a support surface 17 of the adapter 5 which is in the same plane as the lips 11, 11' when the adapter 5 is in its position of rest. When the support surface 17 rests on the surface to be worked on, it ensures that the lips 11, 11' are in the optimum suction position, so that the residual moisture can be minimized.

Figure 4:
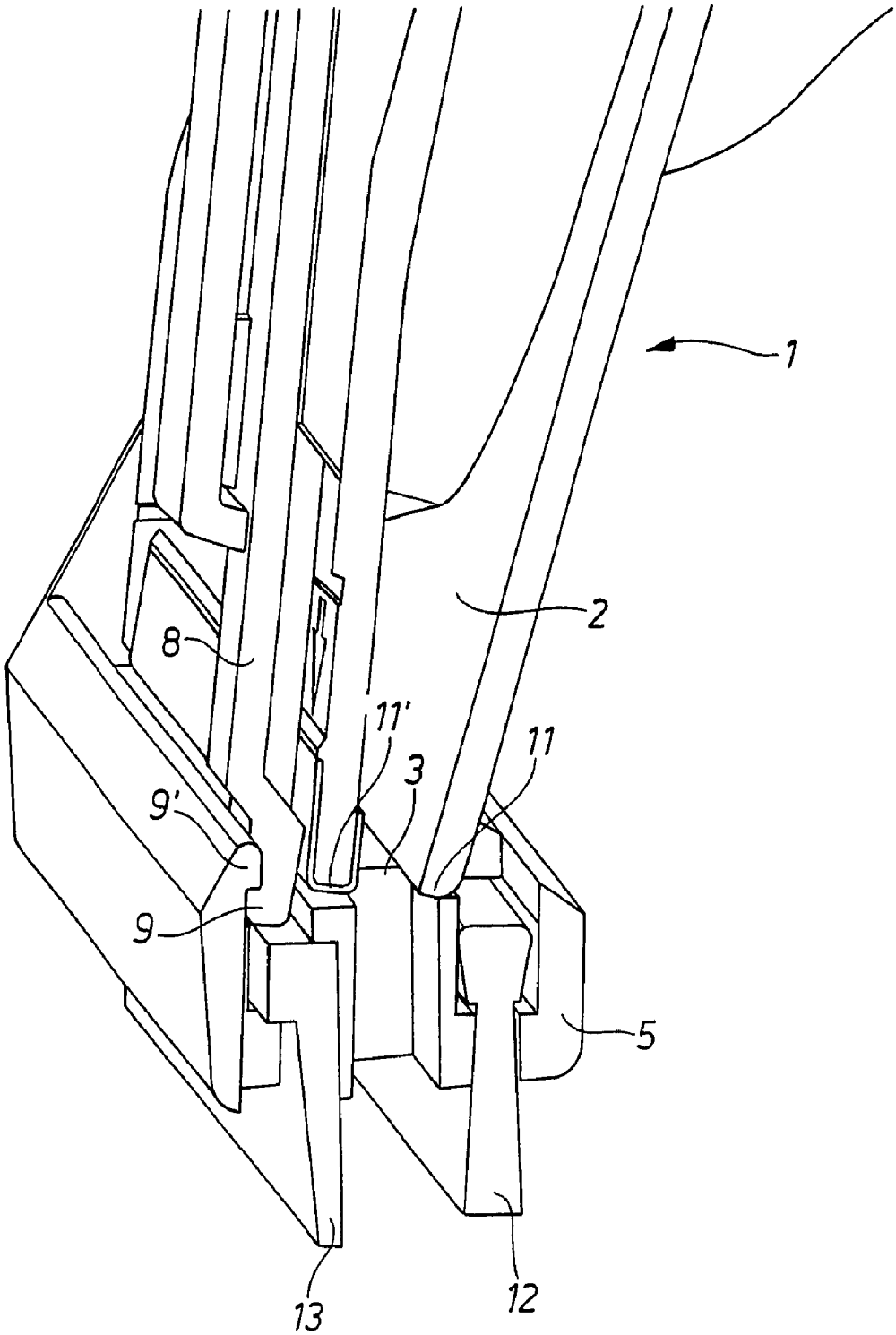
FIG. 4 is a sectional view of the spray extraction nozzle with adapter shown in the position of operation.

FIG. 4 shows a sectional view of the spray extraction nozzle 1, wherein the Figure particularly shows the suction duct 2 and the suction mouth 3 with its lips 11, 11'. The lip 11' serves as a stop for the adapter 5. When the spray extraction nozzle 1 carries out a pulling movement, the adapter 5 is pulled against the lip 11' which serves as a stop. In addition, the bristle ledge 12 and the rubber lip 13 of the adapter 5 can be seen, as well as the locking device 8 which engages with its hooks 9 in appropriate counter hooks 9' of the adapter 5. When the spray extraction nozzle 1 carries out a pushing movement, the hooks 9 and the counter hooks 9' are pulled more and more together, so that the adapter 5 cannot be pivoted. Only when the locking device 8 is pushed, for example, by a foot operation, the hooks 9 slide out of the hooks 9'.

All Figures of the drawing show the essentially triangular shape of the spray extraction nozzle 1, wherein, however, projections 18, 18' are arranged in the lower area in such a way that it is possible to operate underneath pieces of furniture so that no edges which are not worked on are visible.

While specific embodiments of the invention have been shown and described in detail to illustrate the inventive principles, it will be understood that the invention may be embodied otherwise without departing from such principles.

I claim:

1. A spray extraction nozzle for taking in liquids which have been applied to a surface, the spray extraction nozzle comprising a suction duct having a central axis and a suction mouth, and a spray nozzle for the suction mouth, an adapter for working on surfaces having different properties, further comprising a pivot axis substantially perpendicular to the central axis of the suction duct and connecting the adapter and the spray extraction nozzle, wherein the adapter is mounted so as to be pivotable about the pivot axis between a position of rest remote from the suction mouth and a position of operation in front of an inlet opening of the suction mouth of the spray extraction nozzle.

2. The spray extraction nozzle according to claim 1, further comprising means for releasably locking the adapter in the position of operation.

3. The spray extraction nozzle according to claim 1, further comprising means for releasably locking the adapter in the position of rest.

4. The spray extraction nozzle according to claim 1, wherein the adapter comprises in the position of rest a support surface for the spray extraction nozzle, whereby the suction mouth assumes an optimum position relative to the surface to be worked on.

5. The.spray extraction nozzle according to claim 1, wherein the pivot axis is comprised of two pieces, wherein at least one of the pieces can be changed with respect to its position.

6. The spray extraction nozzle according to claim 5, further comprising an actuating device for effecting the change of position of the pivot axis, wherein the degree of the change of position of the pivot axis is adjusted at least such that the pivot axis can be withdrawn from a bore in the adapter which receives the pivot axis.

7. The spray extraction nozzle according to claim 1, wherein the spray extraction nozzle has an essentially triangular shape with lateral protrusions.

8. The spray extraction nozzle according to claim 7, wherein the suction duct has over an entire length thereof the same cross-section as the suction mouth.

* * * * *